US011774161B2

(12) United States Patent
Hanson

(10) Patent No.: US 11,774,161 B2
(45) Date of Patent: Oct. 3, 2023

(54) REFRIGERATED FOOD SERVICE COUNTER

(71) Applicant: James V. Hanson, Powell, OH (US)

(72) Inventor: James V. Hanson, Powell, OH (US)

( * ) Notice: Subject to any disclaimer, the term of this patent is extended or adjusted under 35 U.S.C. 154(b) by 144 days.

(21) Appl. No.: 17/240,049

(22) Filed: Apr. 26, 2021

(65) Prior Publication Data

US 2021/0333040 A1 Oct. 28, 2021

Related U.S. Application Data

(60) Provisional application No. 63/015,779, filed on Apr. 27, 2020, provisional application No. 63/015,779, filed on Apr. 27, 2020.

(51) Int. Cl.

| | |
|---|---|
| ***A47F 3/04*** | (2006.01) |
| ***F25D 19/00*** | (2006.01) |
| ***F25D 23/06*** | (2006.01) |
| ***F25D 25/00*** | (2006.01) |
| ***F25D 11/00*** | (2006.01) |

(52) U.S. Cl.

CPC ..... *F25D 19/006* (2013.01); *A47F 3/0486* (2013.01); *F25D 11/006* (2013.01); *F25D 23/067* (2013.01); *F25D 25/005* (2013.01); *F25D 2400/08* (2013.01)

(58) Field of Classification Search

CPC .... A47F 3/0456; A47F 3/0486; F25D 19/006; F25D 11/006; F25D 23/067; F25D 25/005; F25D 2400/08

See application file for complete search history.

(56) References Cited

U.S. PATENT DOCUMENTS

| | | | | |
|---|---|---|---|---|
| 5,355,687 | A * | 10/1994 | Carpenter | F25D 17/06 62/446 |
| 5,927,092 | A * | 7/1999 | Kushen | A47F 3/0456 62/448 |
| 2011/0030565 | A1* | 2/2011 | Shei | A47J 39/006 219/400 |
| 2014/0150461 | A1* | 6/2014 | Veltrop | F25D 25/024 62/207 |
| 2015/0173526 | A1* | 6/2015 | Delgadillo | F25D 23/061 62/99 |
| 2015/0253062 | A1* | 9/2015 | Lintker | A47F 10/06 62/446 |
| 2018/0184815 | A1* | 7/2018 | Potdar | A47F 3/0439 |

* cited by examiner

*Primary Examiner* — David J Teitelbaum

(74) *Attorney, Agent, or Firm* — McDonnell Boehnen Hulbert & Berghoff LLP

(57) ABSTRACT

A refrigerated food service counter includes a case having sidewalls that define an interior space. A refrigeration unit is in thermal communication with the sidewalls of the case. A bracket is disposed within the interior space, and a food service pan is supported by the bracket. A cooling bar is movably attached to the bracket. The cooling bar is positioned proximate the food service pan and in thermal communication with a select sidewall of the case. The refrigeration unit draws heat from the sidewalls. The select sidewall in turn draws heat from the cooling bar, and the cooling bar in turn draws heat from the food service pan.

10 Claims, 11 Drawing Sheets

REFRIGERATED FOOD SERVICE COUNTER

This non-provisional application claims priority to and the benefit of U.S. Provisional Application No. 63/015,779, filed on Apr. 27, 2020, herein incorporated in its entirety.

FIELD

The present invention relates generally to refrigeration systems and, more particularly, to open-top food pan refrigeration systems.

BACKGROUND

Refrigerated food service counters are used to hold foods that must be kept cold until they are served. Refrigerated food service counters, which usually have an open top cold rail, are commonly used in restaurants where food is made-to-order to the specifications of customers as they pass through a serving line, or chef-prepared foods including pizzas. Additional example uses for refrigerated food service counters include buffet-style restaurants and delicatessens.

Most "cold-wall" type refrigerated food service counters include a built-in refrigeration unit that cools an interior space defined by a set of sidewalls and a floor, and is closed off by one or more removeable food service pans. This interior space is chilled by the refrigeration unit by reducing the temperature of the sidewalls to draw heat out of the interior space. Other refrigerated open top "circulating-air" type cold tables employ cold air movement for cooling. The chilled interior space cools the food service pans and, in turn, the food stored in the pans.

Refrigerated food service counters suffer from a significant drawback in that the refrigeration is only on the sidewalls of the case (for cold-wall counters) or are reliant upon air movement in the restricted space (for circulating-air counters) for the heat transfer from pans to a cold base. The stagnant, chilled air in the interior space of cold-wall refrigerated food service counters is a poor heat conductor and thus is only partially effective to keep the pans cool. Circulating-air counters rely on cold air movement in a restricted space and likewise cannot maintain temperatures in the top sections of the open pans. Consequently, after a period of time the food in the pans of the refrigerated food service counters becomes too warm to be safely consumed and must be disposed of. This is a needless waste of food and money.

Others have attempted to enhance the cooling effects of cold-wall refrigerated food service counters by using various air-movement devices such as fans. Fans do improve cooling performance but they also suffer from drawbacks. For example, more than one fan is usually required to adequately circulate chilled air, increasing the cost of refrigerated food service counters. Circulation fans also have a relatively limited service life, resulting in increased maintenance cost. Drawbacks aside, many users of this equipment are not in a position to bear the expense of replacing their entire counter in order to improve cooling performance and would like to upgrade the equipment they have, but experience has shown that fans are not easily added to existing refrigerated food service counters.

Another option to improve cooling of food is to keep the pans covered when not dispensing the food. This does improve cooling performance in theory, but is usually impractical since the lids are constantly being removed to dispense food. In addition, the lids tend to interfere with the restaurants' desire to attractively display their food and/or restrict access to the pans for the food assembler. As a result, the lids are rarely effectively used.

Another attempt at improving cooling of food service pans involves use of a solid divider bracket or partition between the pans. The solid divider brackets or partitions include interior refrigeration lines and a food-safe refrigerant is circulated through the lines to provide additional cooling. Examples of such arrangements may be found in U.S. Pat. Nos. 6,202,432, 5,927,092, and 5,355,687 as well as LiquiTec® Cold Pans provided by the Delfield Company of Mount Pleasant, Mich. Although such systems do improve cooling, they are very expensive and are cumbersome with respect to installation, cleaning and removal. They also increase maintenance cost. There remains a need for a better way to keep food in refrigerated food service counters cool.

SUMMARY

The present invention utilizes cooling bars coupled to divider brackets that are positioned adjacent to the food service pans of refrigerated food service counters. The cooling bars are in thermal communication with the cooling sidewalls of the refrigerated food service counters and act as heat sinks to draw heat away from the pans.

In one embodiment of the present invention the cooling bars are magnetically and slidably coupled to the divider brackets, making them easily positionable for optimum thermal performance. The magnetically-coupled cooling bars are also easily removable for cleaning or replacement.

The present invention keeps food colder than can normally be achieved with refrigerated food service counters, requires no additional power to operate, and does not wear out. The cold bars of the present invention are also easily retrofittable to existing refrigerated food service counters, making improvements in cooling efficiency available at reasonable cost.

In one embodiment of the present invention a refrigerated food service counter includes a case having sidewalls that define an interior space. A refrigeration unit is in thermal communication with the sidewalls of the case. A bracket is disposed within the interior space, and a food service pan is supported by the bracket. A cooling bar is movably attached to the bracket. The cooling bar is positioned proximate the food service pan and in thermal communication with a select sidewall of the case. The refrigeration unit is in thermal communication with and draws heat from the sidewalls. The select sidewall in turn draws heat from the cooling bar, and the cooling bar in turn draws heat from the food service pan.

In another embodiment of the present invention a refrigerated food service counter includes a case having sidewalls. A refrigeration unit is in thermal communication with the sidewalls, and a ledge is attached to the sidewalls. A cooling frame is selectably supported by the ledge, the cooling frame being sized for thermal communication with the sidewalls of the case and having an opening. A food service pan is selectably disposed within the opening of the cooling frame. The refrigeration unit draws heat from the sidewalls, the sidewalls draw heat from the cooling frame, and the cooling frame draws heat from the food service pan.

BRIEF DESCRIPTION OF THE DRAWINGS

Further features of the present invention will become apparent to those skilled in the art to which the present invention relates from reading the following specification with reference to the accompanying drawings, in which.

DETAILED DESCRIPTION

Figure 1:
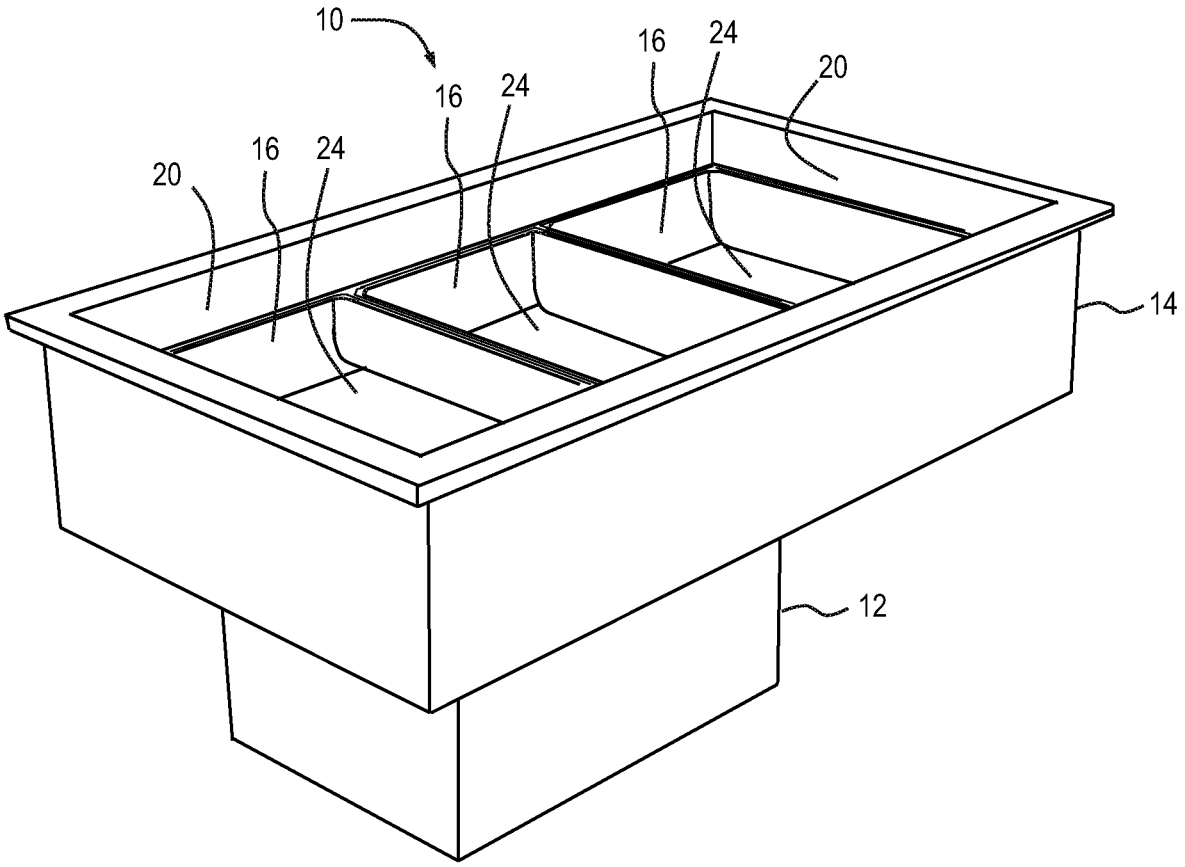
Fig. 1 Prior Art
FIG. 1 shows a prior art drop-in "cold-wall" type refrigerated food service counter.
Figure 2:
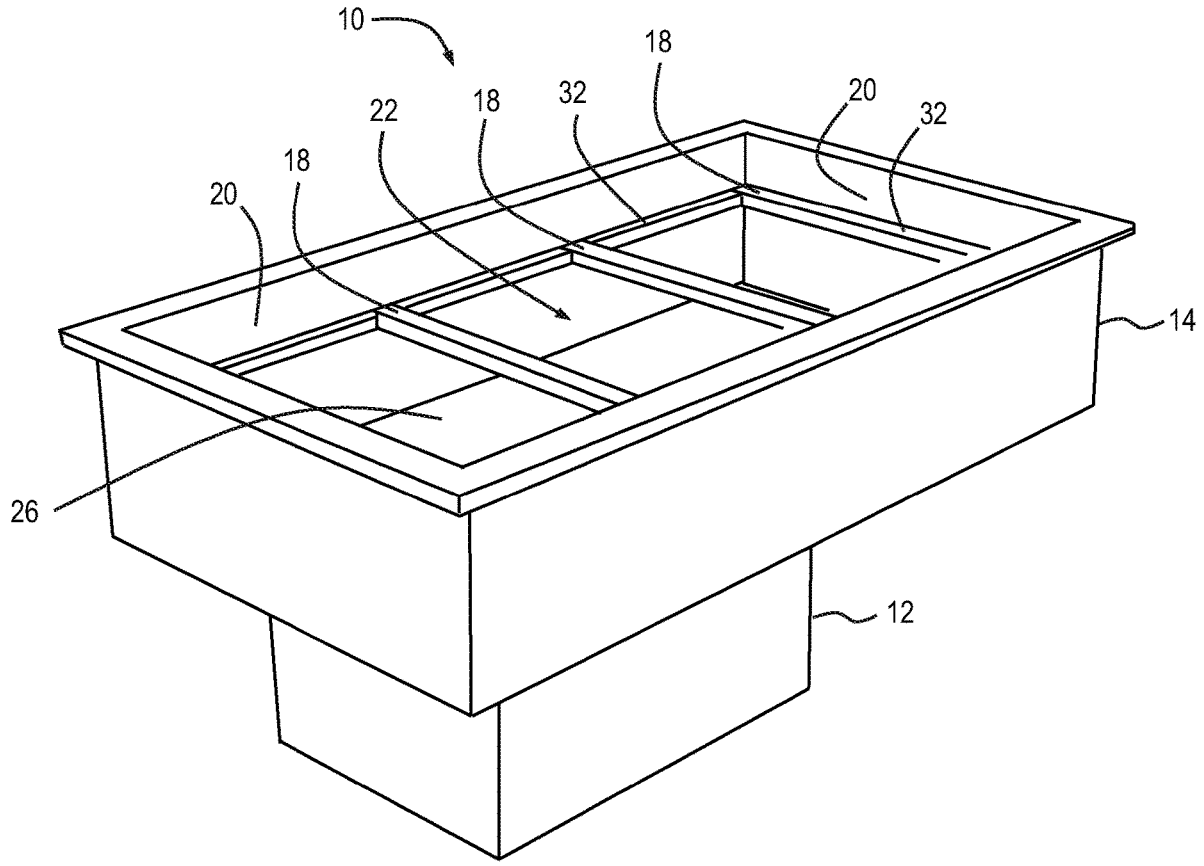
Fig. 2 Prior Art
FIG. 2 shows the refrigerated food service counter of FIG. 1 with a set of food service pans removed to show interior features of the refrigerated food service counter.

The general arrangement of a prior art refrigerated food service counter 10 (hereafter "counter 10" or "counter") is shown in FIGS. 1 and 2 according to an embodiment of the present invention. Counter 10 comprises, in pertinent part, a refrigeration unit 12, a case (also interchangeably termed "cold pan unit") 14, one or more food service pans 16, and one or more divider brackets (also interchangeably termed "adapter bars") 18 to support the food service pans. Refrigeration unit 12 is in thermal communication with and draws heat from a pair of opposing interior sidewalls 20 of case 14. The chilled interior sidewalls 20 in turn cool an air space 22, which is generally defined by a bottom 24 of pans 16, the interior sidewalls, and a floor 26 of the case.

Figure 3:
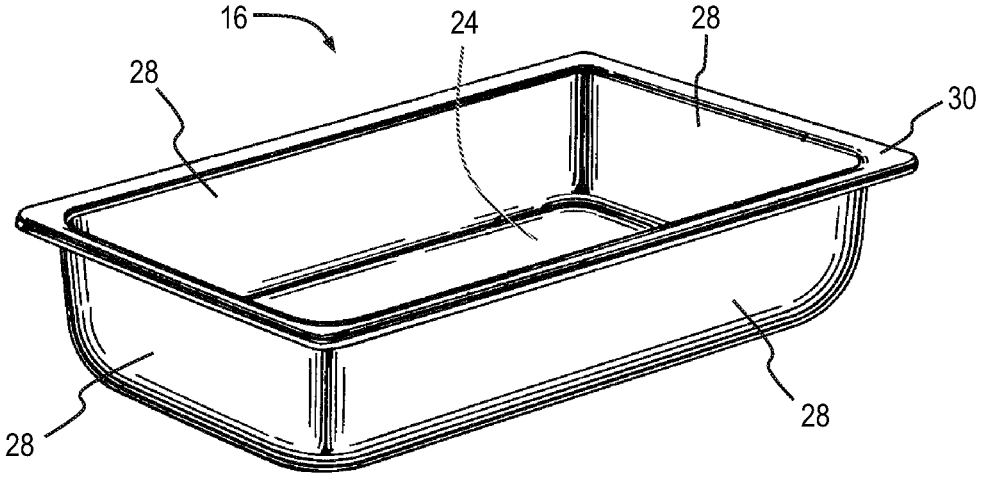
Fig. 3 Prior Art
FIG. 3 shows further details of the food service pans of FIG. 1.

Further details of food service pan 16 are shown in FIG. 3. Food service pan 16 comprises bottom 24, a set of sides 28, and a lip 30. When installed in counter 10, lip 30 of pan 16 rests upon dividers 18 and a support ledge 32 of case 14 (FIGS. 1, 2).

Further details of divider bracket 18 are shown in FIGS. 4A, 4B, 4C and 4D. Divider bracket 18 comprises a pair of opposing end tabs 34 extending from a longitudinal upper portion 36. A pair of spaced-apart, generally parallel flanges 38 extend generally orthogonally from upper portion 36, forming a cavity 40. Divider bracket 18 is preferably made from a magnetically-attractive grade of stainless steel.

FIGS. 5A, 5B, 5C, 5D, 5E and 5F show top, first end, side, second end, bottom, and perspective views respectively of a cooling bar 42 according to an embodiment of the present invention. Cooling bar 42 is generally rectangular in shape with a chamfered edge 44, although other shapes for the cooling bar are within the scope of the invention. A generally planar first end 46 is defined by chamfered edge 44, a first side 48, a second, opposing side 50 and a bottom side 52. A second, opposing end 54 extends between an upper side 56 and bottom side 52 and is defined by sides 48, 50.

Cooling bar 42 has a thickness "T," generally defined as the distance between first side 48 and second side 50. Thickness T is preferably dimensioned such that the cooling bar fits slidably into cavity 40 of divider bracket 18 (FIGS. 4A, 4B, 4C, 4D).

Cooling bar 42 may be made solid in cross-section from any suitable material such as, without limitation, aluminum, stainless steel and copper alloys. Cooling bar 42 may further be finished or coated as desired for esthetic purposes or to protect it from environmental degradation. Example finishes and coatings include, but are not limited to, anodizing, chromate conversion coating, liquid paint, and powder coating.

In an alternate embodiment of the present invention cooling bar 42 may be a substantially hollow enclosure. Such an enclosure may be filled with or contain a heat-transfer fluid, such as a food-grade eutectic fluid.

It should be noted that the figures herein show cooling bar 42 in a basic form for clarity. However, it is preferable that sharp edges and corners be removed from cooling bar 42 with deburring, chamfers, breaking, fillets, bevels, radii and so on as suited to particular embodiments thereof. It should be further noted that cooling bar 42 may include distinctive or decorative shapes, forms and sizes as desired within the scope of the invention.

A generally planar magnet 58 is attached to upper side 56 of cooling bar 42 in any suitable manner including, without limitation, screws 60, fasteners, and adhesives. Magnet 58 may be mounted atop a surface 62 of upper side 56 as shown. Alternatively, magnet 58 may be disposed within a pocket or hollow of upper side 56 such that a top surface 64 of the magnet is also generally flush with the surface 62 of the upper side. If screws 60 are used to attach magnet 58 to upper side 56, the screws are preferably generally flush with top surface 64 of the magnet.

Magnet 58 may be any suitable type of permanent magnet. Examples include, but are not limited to, neodymium iron boron (NdFeB), samarium cobalt (SmCo), alnico, and ceramic or ferrite magnets.

Figure 4A:
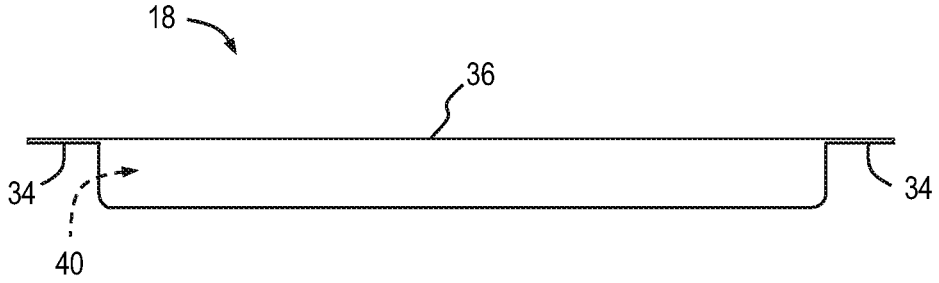
FIGS. 4A, 4B, 4C and 4D show side, bottom, top, and end views respectively of a divider bracket.
Figure 4B:
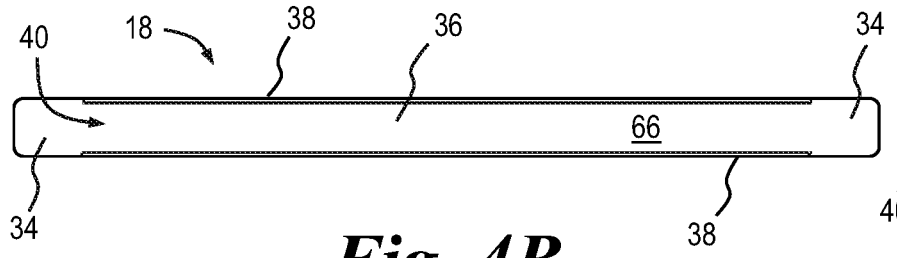
Figure 4D:
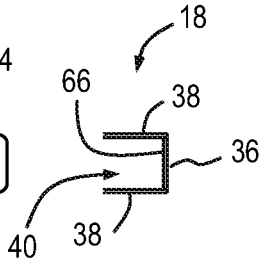
Figure 4C:
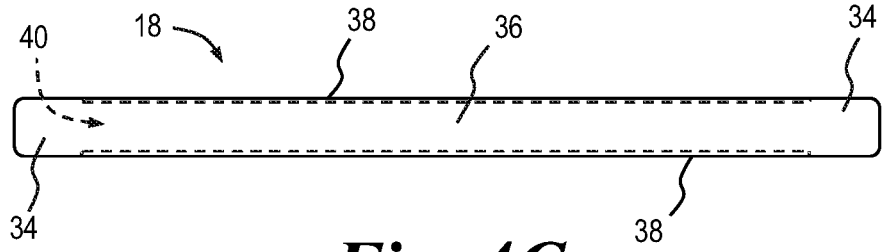
Figure 5A:
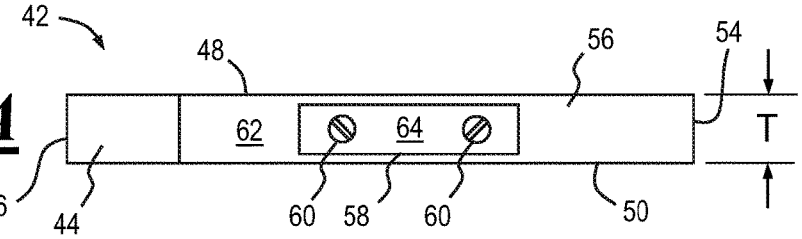
FIGS. 5A, 5B, 5C and 5D, 5E and 5F show top, first end, side, second end, bottom, and perspective views respectively of a cooling bar according to an embodiment of the present invention.
Figure 5B:
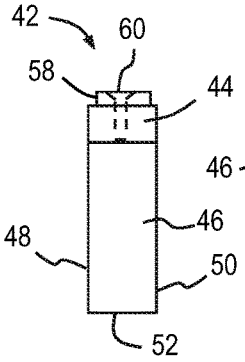
Figure 5C:
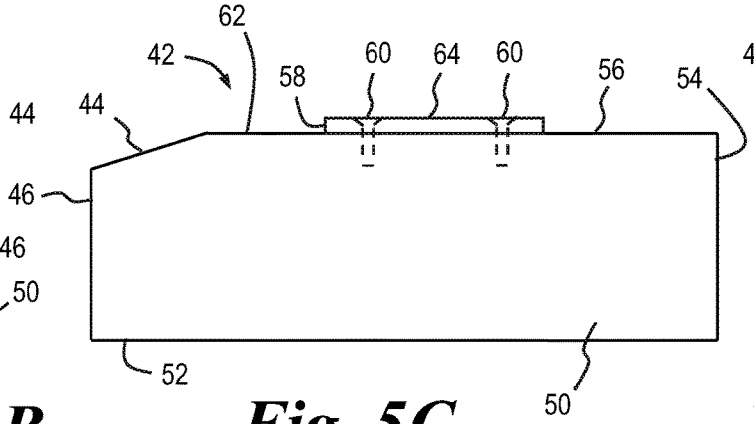
Figure 5D:
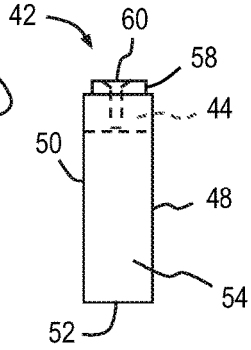
Figure 5E:
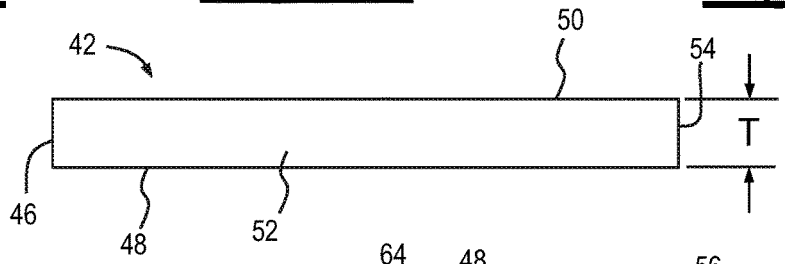
Figure 5F:
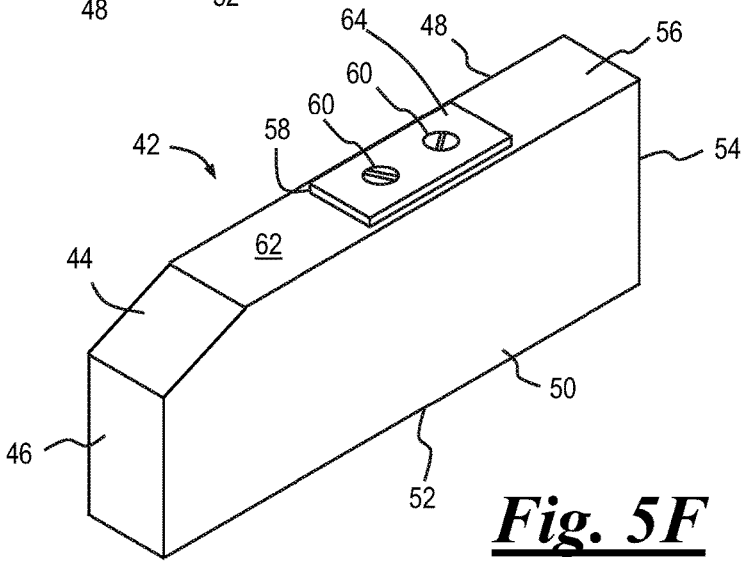
Figure 6A:
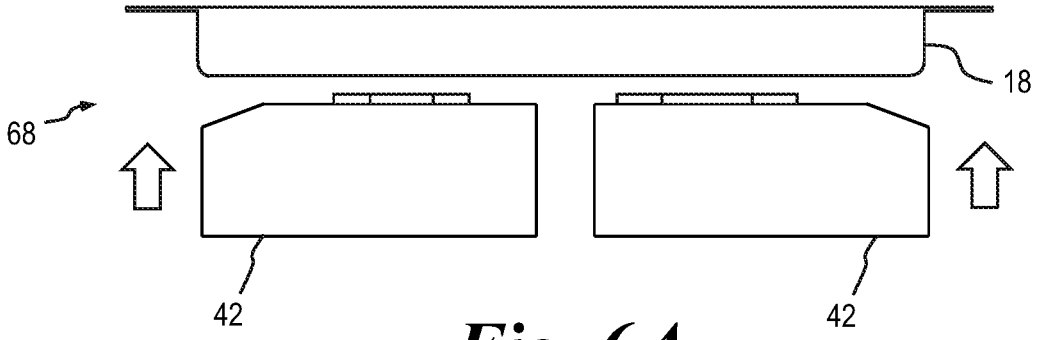
FIGS. 6A, 6B and 6C show the assembly of cooling bars to a divider bracket according to an embodiment of the present invention.
Figure 6B:
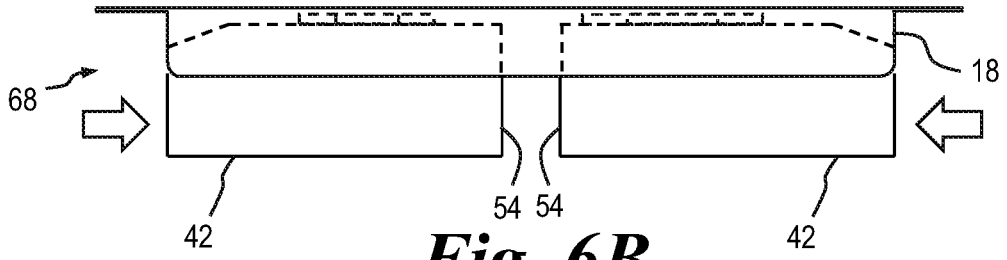

With reference now to FIG. 6A, a pair of cooling bars 42 are assembled to a divider bracket 18 to form an assembly 68 by inserting them back-to-back into cavity 40 of the divider bracket such that second ends 54 of the cooling bars are facially adjacent and the magnets 58 come into contact with and slidably, magnetically engage an interior surface 66 of upper portion 36 of the divider bracket (FIG. 4B). The cooling bars 42 are then slidably adjusted along the longitudinal length of divider bracket 18 such that their second ends 54 are generally proximate one another, as shown in FIG. 6B.

Figure 6C:
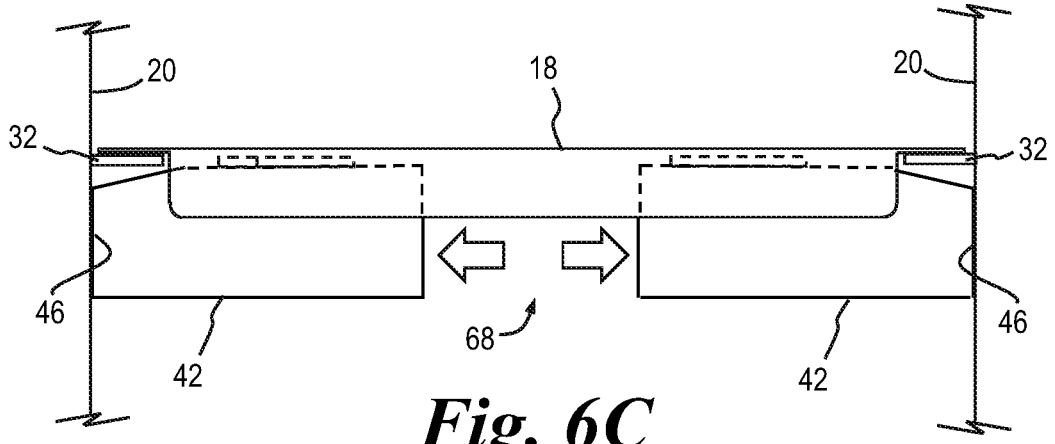
Figure 7:
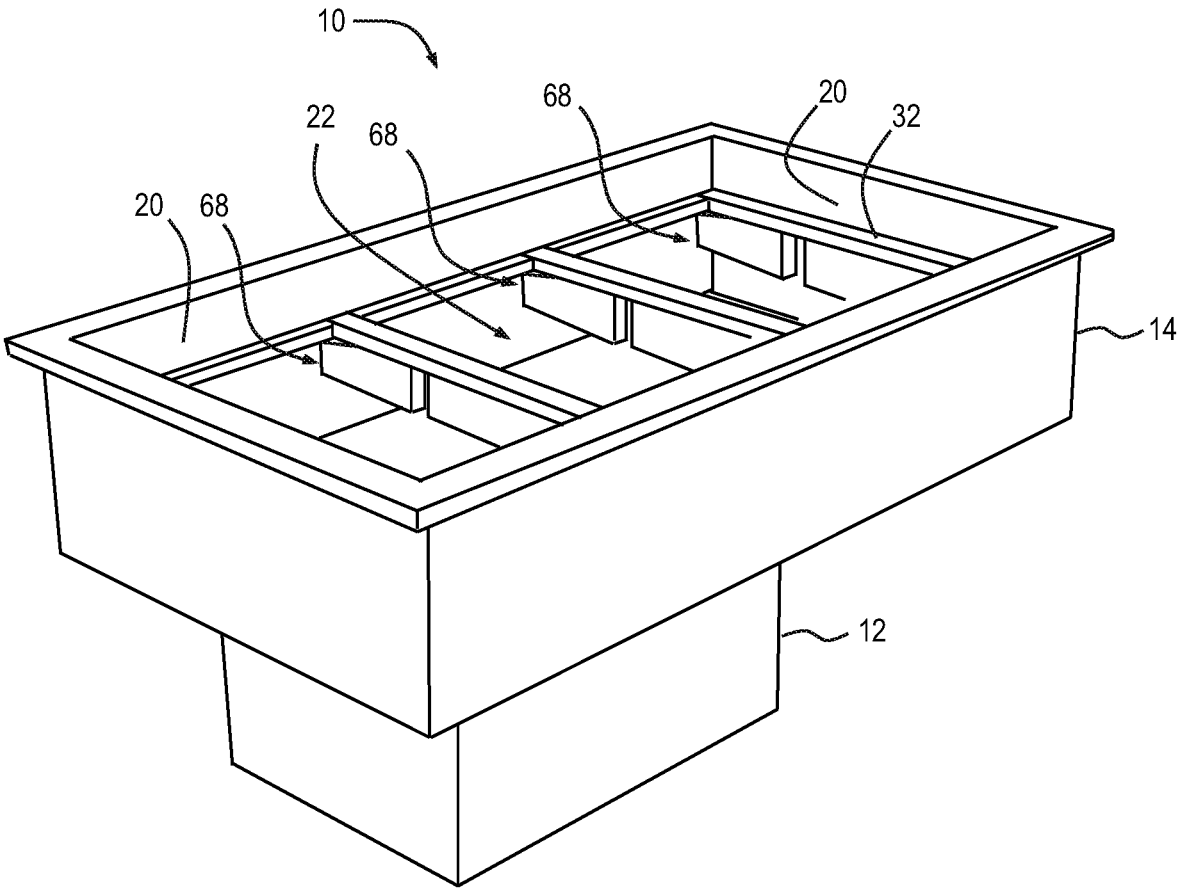
FIG. 7 shows a refrigerated food service counter with food service pans removed for clarity to show the assemblies of FIGS. 6A, 6B and 6C installed therein.
Figure 8A:
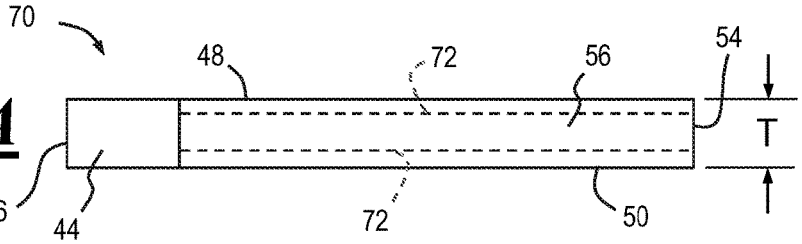
FIGS. 8A, 8B, 8C and 8D, 8E and 8F show top, first end, side, second end, bottom, and perspective views respectively of a cooling bar according to an alternate embodiment of the present invention.
Figure 8B:
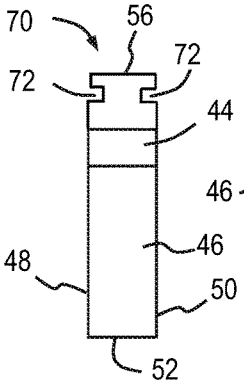
Figure 8C:
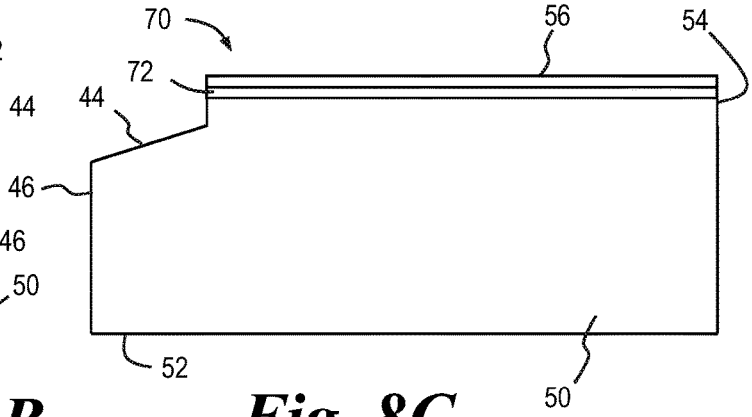
Figure 8D:
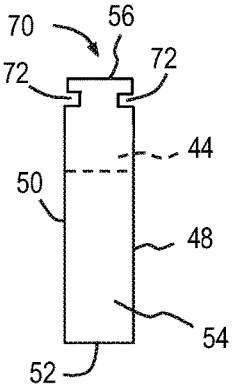
Figure 8E:
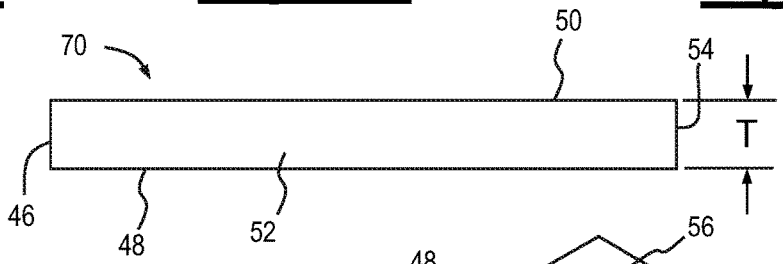
Figure 8F:
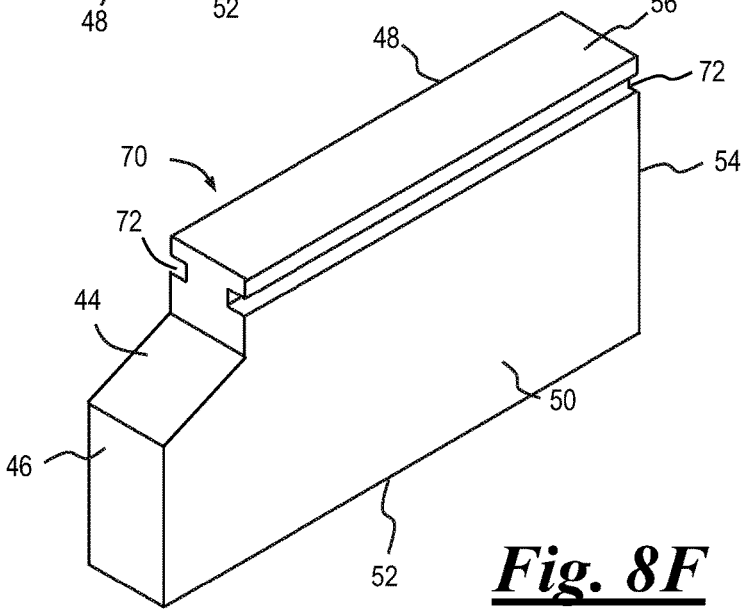
Figure 9A:
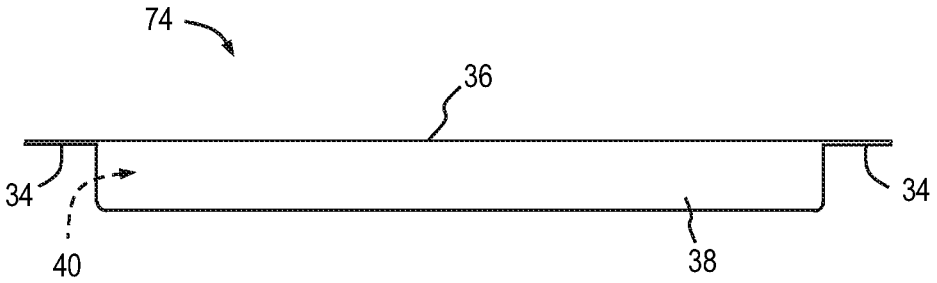
FIGS. 9A, 9B, 9C and 9D show side, bottom, top, and end views respectively of a divider bracket according to an alternate embodiment of the present invention.
Figure 9B:
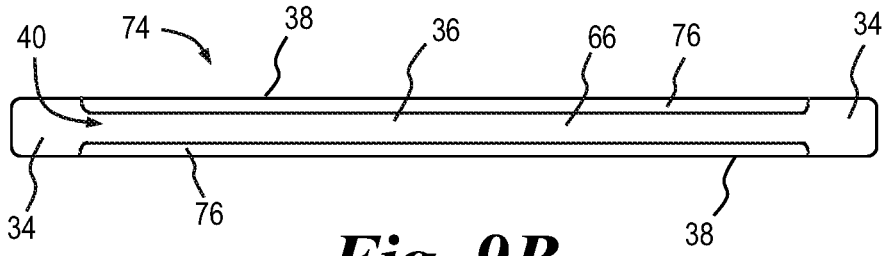
Figure 9D:
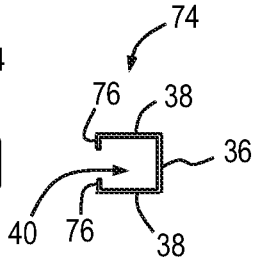
Figure 9C:
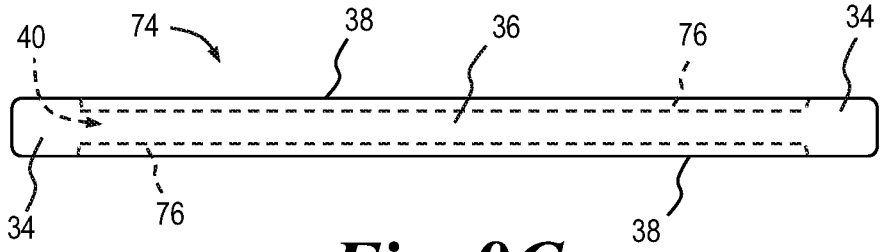

Referring to FIGS. 1, 6C and 7 together, a suitable quantity of assemblies 68 are installed into case 14, such quantity depending upon the number of pans 16 to be installed into the case. Preferably, the quantity of assemblies 68 is selected such that there is one assembly between each pan 16. Optionally, assemblies 68 may be placed between the outer pans 16 and interior sidewall 20 of case 14. Each assembly 68 is installed into case 14 such that the end tabs 34 of the divider brackets 18 rest upon ledge 32 of the case. As shown in FIG. 6C, the cooling bars 42 are each slidably moved along the longitudinal length of divider bracket 18 toward respective, opposing interior sidewalls 20 until the first end 46 of each cooling bar comes into contact with the respective interior sidewall, with chamfered edge 44 of the cooling bar fitting under the ledge 32.

In operation, cooling bars 42 are in thermal communication with the refrigerated interior sidewalls 20, drawing heat from the cooling bars and causing the cooling bars to become chilled. The sides 48, 50 of the cooling bars 42 are closely proximate the sides 28 of adjacent pans 16 such that the cooling bars 42 are also in thermal communication with the pans. This arrangement allows cooling bars 42 to act as heat sinks, drawing heat away from the pans 16 and transferring it to sidewalls 20 of case 14, effectively and efficiently cooling the pans.

Cooling bars 42 may be easily and quickly removed from divider brackets 18 for cleaning them manually or with automatic washing equipment. After cleaning, the cooling bars 42 and divider brackets 18 may be likewise quickly and easily reassembled to form assemblies 68 and reinstalled into a counter 10 in the manner discussed above.

Many counters 10 utilize common or standard parts. As a result, existing counters 10 may be inexpensively and easily retrofitted with assemblies 68 by simply replacing the counters' divider brackets with assemblies. In some instances, cooling bars 42 may be retrofitted to the existing divider brackets of counters 10, allowing the old divider brackets to continue to be used.

Although the present invention is directed primarily to cold-wall types of counters, cooling bars 42 may also be used to advantage with circulating-air types of counters. In such counters assemblies 68 (or an alternate arrangement of cooling bars 42) assist in maintaining a cold temperature by drawing heat from upper portions of the food service pans 16 down further into the chilled air space 22 of the cold table. In this arrangement the cooling bars 42 act as a heat sink to keep the upper open section of the pans 16 at a lower temperature.

FIGS. 8A, 8B, 8C, 8D, 8E and 8F show top, first end, side, second end, bottom, and perspective views respectively of a cooling bar 70 according to an alternate embodiment of the present invention. Like cooling bar 42, cooling bar 70 is generally rectangular in shape with a chamfered edge 44, although other shapes for the cooling bar are within the scope of the invention. A generally planar first end 46 is defined by chamfered edge 44, a first side 48, a second, opposing side 50 and a bottom side 52. A second, opposing end 54 extends between an upper side 56 and bottom side 52. Cooling bar 70 further includes a pair of opposing grooves or slots 72 formed in first and second sides 48, 50 respectively. Grooves or slots 72 may be integral to cooling bar 70, or may be a separate piece that is attached to the cooling bar. Cooling bar 70 may be otherwise similar to cooling bar 42, and the alternate embodiments and features of cooling bar 42 discussed above may be likewise applied to cooling bar 70.

A divider bracket 74 is shown in FIGS. 9A, 9B, 9C and 9D according to an alternate embodiment of the present invention. Divider bracket 74 comprises a pair of opposing end tabs 34 extending from a longitudinal upper portion 36. A pair of spaced-apart, generally parallel flanges 38 extend generally orthogonally from upper portion 36, forming a cavity 40. Divider bracket 74 is preferably made from a magnetically-attractive grade of stainless steel. Flanges 38 further include opposing, spaced-apart connecting tabs 76 that are oriented generally orthogonally to the flanges. Divider bracket 74 may be otherwise similar to divider bracket 18, and the alternate embodiments and features of divider bracket 18 discussed above may be likewise applied to divider bracket 74.

Figure 10A:
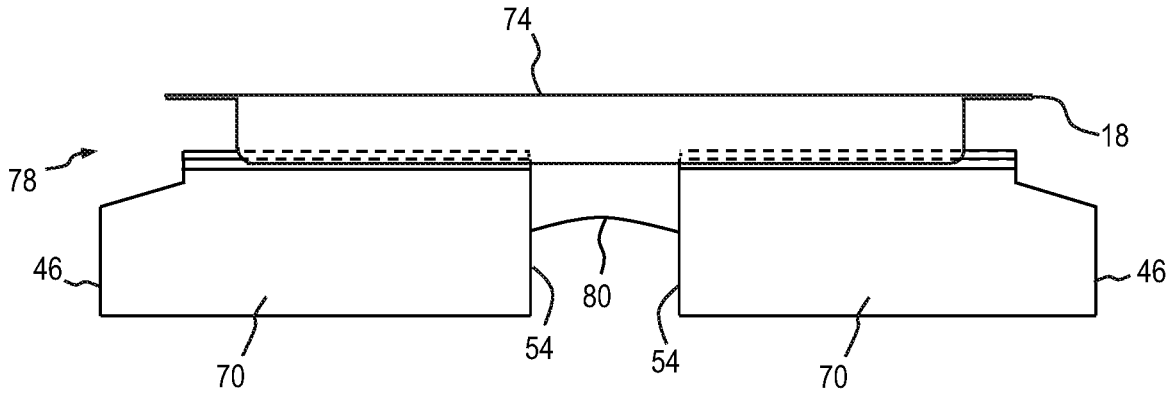
FIGS. 10A and 10B show the assembly of cooling bars to a divider bracket according to another alternate embodiment of the present invention.
Figure 10B:
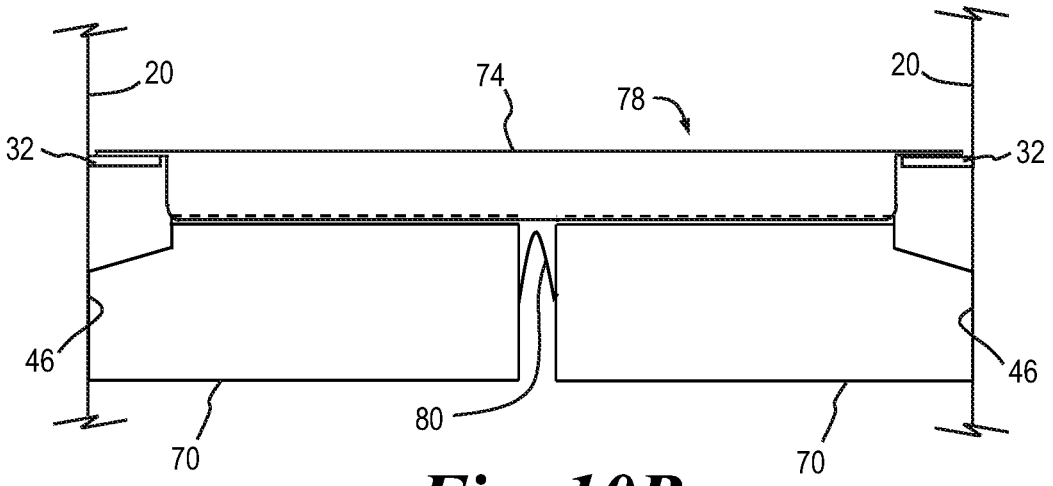

With reference now to FIG. 10A, a pair of cooling bars 70 are coupled to a divider bracket 74 to form an assembly 78 by slidably inserting them back-to-back into cavity 40 of the divider bracket such that second ends 54 of the cooling bars are facially adjacent and the grooves or slots 72 of the cooling bars slidably engage corresponding connecting tabs 76 of the divider bracket (FIG. 10B). One or more biasing elements, 80 such as, but not limited to, a leaf spring or a coiled spring, is placed between the cooling bars 70 and attached to the cooling bars in any suitable manner. Biasing element 80 acts to urge cooling bars 70 away from each other, the slots or grooves 72 of the cooling bars moving slidably along respective connecting tabs 76 of divider bracket 74. Assembly 78 may be otherwise similar to assembly 68, and the alternate embodiments and features of assembly 68 discussed above may be likewise applied to assembly 78.

Referring to FIGS. 1, 7 and 10B together, a suitable quantity of assemblies 78 are installed into case 14, such quantity depending upon the number of food pans 16 to be installed into the case. Preferably, the quantity of assemblies 78 is selected such that there is one assembly between each pan 16. Optionally, assemblies 78 may be placed between the outer pans 16 and interior sidewall 20 of case 14. Each assembly 78 is installed into case 14 such that the end tabs 34 of the divider brackets 74 rest upon ledge 32 of the case. As shown in FIG. 10B, the cooling bars 70 are each slidably urged toward respective, opposing interior sidewalls 20 by biasing element 80, the slots or grooves 72 of the cooling bars moving slidably along respective connecting tabs 76 of divider bracket 74 until a first end 46 of each cooling bar comes into contact with the interior sidewall with chamfered edge 44 of the cooling bar fitting under the ledge 32.

In operation, cooling bars 70 are in thermal communication with the refrigerated interior sidewalls 20 similarly to cooling bars 42, drawing heat from the cooling bars and causing the cooling bars to become chilled. The sides 48, 50 of the cooling bars 70 are closely proximate the sides 28 of adjacent pans 16 such that the cooling bars are also in thermal communication with the pans. This arrangement allows cooling bars 70 to act as heat sinks, drawing heat away from the pans 16 and transferring it to sidewalls 20 of case 14, effectively and efficiently cooling the pans.

Cooling bars 70 and biasing element 80 may be easily and quickly removed from divider brackets 74 for cleaning the pieces manually or with automatic washing equipment. After cleaning, the cooling bars 70, divider brackets 74 and biasing element 80 may be likewise quickly and easily reassembled to form assemblies 78 and reinstalled into a counter 10 in the manner discussed above for assemblies 68.

Figure 11:
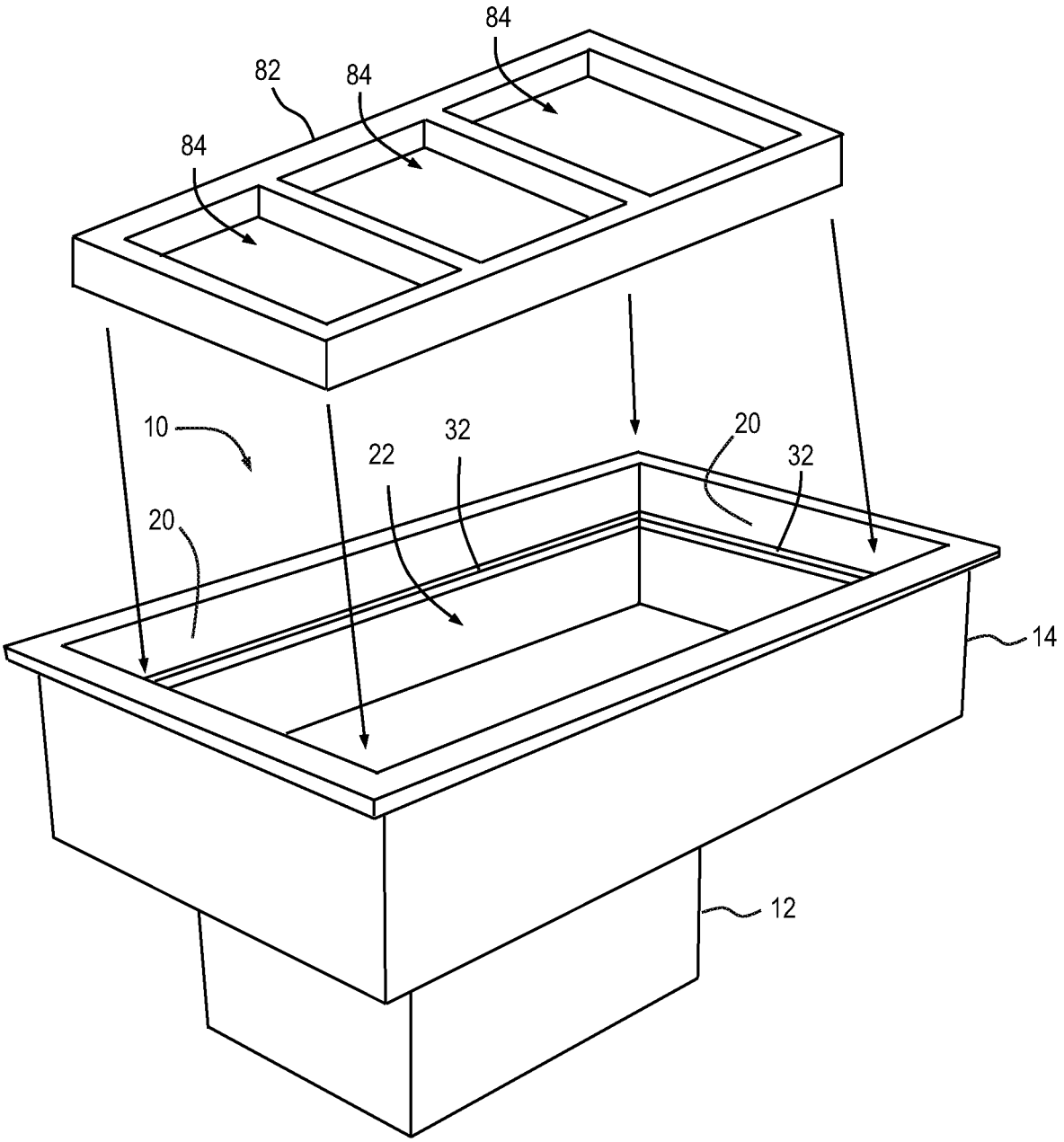
FIG. 11 shows a cooling frame according yet another alternate embodiment of the present invention.

A cooling frame 82 is shown in FIG. 11 according yet another alternate embodiment of the present invention. Cooling frame 82 is sized and shaped to fit into a counter 10 and rest upon ledge 32 of case 14. Cooling frame 82 further includes one or more openings 84 that are sized and shaped to receive food service pans 16 (FIG. 3).

Preferably, cooling frame 82 is sized and shaped to be positioned in close proximity to or in contact with interior sidewalls 20 of case 14 while resting upon ledge 32. Similarly, openings 84 are preferably sized and shaped to be in contact with or in close proximity to sides 28 of food pan(s) 16 (FIG. 3) to achieve thermal communication therewith.

Cooling frame 82 may be made from any suitable material such as, without limitation, aluminum, stainless steel and copper alloys. Cooling frame 82 may further be finished or coated as desired for esthetic purposes or to protect it from environmental degradation. Example finishes and coatings include, but are not limited to, anodizing, chromate conversion coating, liquid paint, and powder coating.

Cooling frame 82 may be solid in cross-section, or in an alternate embodiment of the present invention, the cooling frame may be a substantially hollow enclosure. Such an enclosure may be filled with or contain a heat-transfer fluid, such as a food-grade eutectic fluid.

Cooling frame 82 may be made as a unitary "single-piece" construction by casting and/or machining, for example. Alternatively, cooling frame 82 may be made in separate pieces that are either permanently or selectably assembled together.

In operation, cooling frame 82 is installed into a case 14 and rests upon ledge 32 such that the cooling frame is in thermal communication with the refrigerated interior sidewalls 20 of the case (the sidewalls being in thermal communication with refrigeration unit 12), drawing heat from the cooling frame and causing the cooling frame to become chilled. The openings 84 of cooling frame 82 are sized and shaped as discussed above to be in contact with or closely proximate the sides 28 of adjacent pans 16 such that the cooling frame is also in thermal communication with the pans. This arrangement allows cooling frame 82 to act as a heat sink, drawing heat away from the pans 16 and transferring it to sidewalls 20 of case 14, effectively and efficiently cooling the pans.

Cooling frame 82 may be installed into case 14 by resting it upon ledge 32 as described above, as the ledge provides for easy and rapid installation and removal of the cooling frame. However, cooling frame 82 is not limited to mounting in this manner and may alternatively be installed into case 14 and in thermal communication with sidewall 20 by any desired temporary or permanent means including, but not limited to, fasteners, connectors, clips and screws.

While the description and drawings describe a "drop-in" type of cold pan, it should be noted that with some refrigerated food service counters the cold pan may be configured as an assembly that is mounted or attached to a refrigerated cabinet. In these types of refrigerated food service counters, the cold pan is integral to a refrigerated cabinet base unit. The present invention is equally applicable to such refrigerated food service counters. The present invention may also be used to advantage with refrigerated "circulating-air" type refrigerated food service counters that employ cold air movement from inside a refrigerated base for cooling. In these types of refrigerated food service counters the cooling bars and cooling frame of the present invention serve as a heat sink to assist in keeping the upper portion of the food pans colder—as contrasted with present circulating-air refrigerated food service counters, which have only a divider bracket and only the bottom of the cold pan cooled by the refrigerated base below.

From the above description of the invention, those skilled in the art will perceive improvements, changes, and modifications in the invention. Such improvements, changes, and modifications within the skill of the art are intended to be covered.

What is claimed is:

1. A refrigerated food service counter, comprising:

a case having sidewalls defining an interior space;

a refrigeration unit in thermal communication with the sidewalls of the case;

at least one bracket disposed within the interior space; a food service pan supported by the bracket; and at least one cooling bar movably attached to the bracket with a magnet, positioned proximate the food service pan, and in thermal communication with a select sidewall of the case, the refrigeration unit drawing heat from the sidewalls, the select sidewall drawing heat from the cooling bar, and the cooling bar drawing heat from the food service pan.

2. The refrigerated food service counter of claim 1 wherein:

the sidewalls of the case include a pair of opposing sidewalls; and the at least one cooling bar comprises a pair of cooling bars, the cooling bars each being in thermal communication with a corresponding opposing sidewall.

3. The refrigerated food service counter of claim 2 wherein the cooling bars are slidably attached to the bracket.

4. The refrigerated food service counter of claim 2 wherein:

the cooling bars each further include a pair of longitudinal, opposing slots; and the bracket further includes a pair of longitudinal, spaced-apart flanges configured to slidably receive the slots of the cooling bars.

5. The refrigerated food service counter of claim 4, further comprising a biasing element to urge the cooling bars apart from one another and into thermal communication with a corresponding sidewall.

6. The refrigerated food service counter of claim 5 wherein the biasing element is one of a coiled spring and a leaf spring.

7. The refrigerated food service counter of claim 1 wherein the cooling bar further includes a planar end, the end being in thermal communication with the sidewalls.

8. The refrigerated food service counter of claim 1 wherein the cooling bar is made from at least one of aluminum, stainless steel and copper alloys.

9. The refrigerated food service counter of claim 1 wherein the cooling bar is solid in cross-section.

10. The refrigerated food service counter of claim 1 wherein:

the at least one bracket comprises a pair of brackets; and the at least one cooling bar comprises a plurality of cooling bars, at least one of the plurality of cooling bars being movably attached to each bracket, the cooling bars being positioned proximate opposing sides of the food service pan, and the cooling bars being in thermal communication with corresponding sidewalls of the case.

* * * * *